United States Patent [19]

Higgins et al.

[11] Patent Number: 4,595,027

[45] Date of Patent: Jun. 17, 1986

[54] ROD WEIGHT CONTROL FOR A CIGARETTE MAKING MACHINE

[75] Inventors: Charles T. Higgins; H. Neal Nunnally, both of Richmond, Va.

[73] Assignee: Philip Morris Incorporated, New York, N.Y.

[21] Appl. No.: 608,327

[22] Filed: May 8, 1984

[51] Int. Cl.[4] ..... A24C 5/18

[52] U.S. Cl. ..... 131/280; 131/84.4; 131/905; 131/906; 131/908

[58] Field of Search ..... 131/905, 906, 908, 84 C, 131/280, 84.4

[56] References Cited

U.S. PATENT DOCUMENTS

| | | | |
|---|---|---|---|
| 3,878,982 | 4/1975 | Hoffman | 131/905 |
| 4,036,238 | 7/1977 | Okumoto | 131/904 |
| 4,280,516 | 7/1981 | Reuland | 131/84 C |
| 4,284,087 | 8/1981 | Reuland | 131/84 C |

*Primary Examiner*—V. Millin

[57] ABSTRACT

A control system for a cigarette making machine to provide improved cigarette rod weight control by continual adjustment of a servo-positioned ecreteur knife at the tobacco supply vacuum belt of the cigarette maker. The servo is positioned by a dual mode control system wherein one mode is based on long term feedback of cigarette rod density, measured by a $\beta$ ray gauge and a second mode based on a high speed adaptive feed-forward control based on tobacco density on the supply vacuum belt measured by a pneumatic gauge.

5 Claims, 1 Drawing Figure

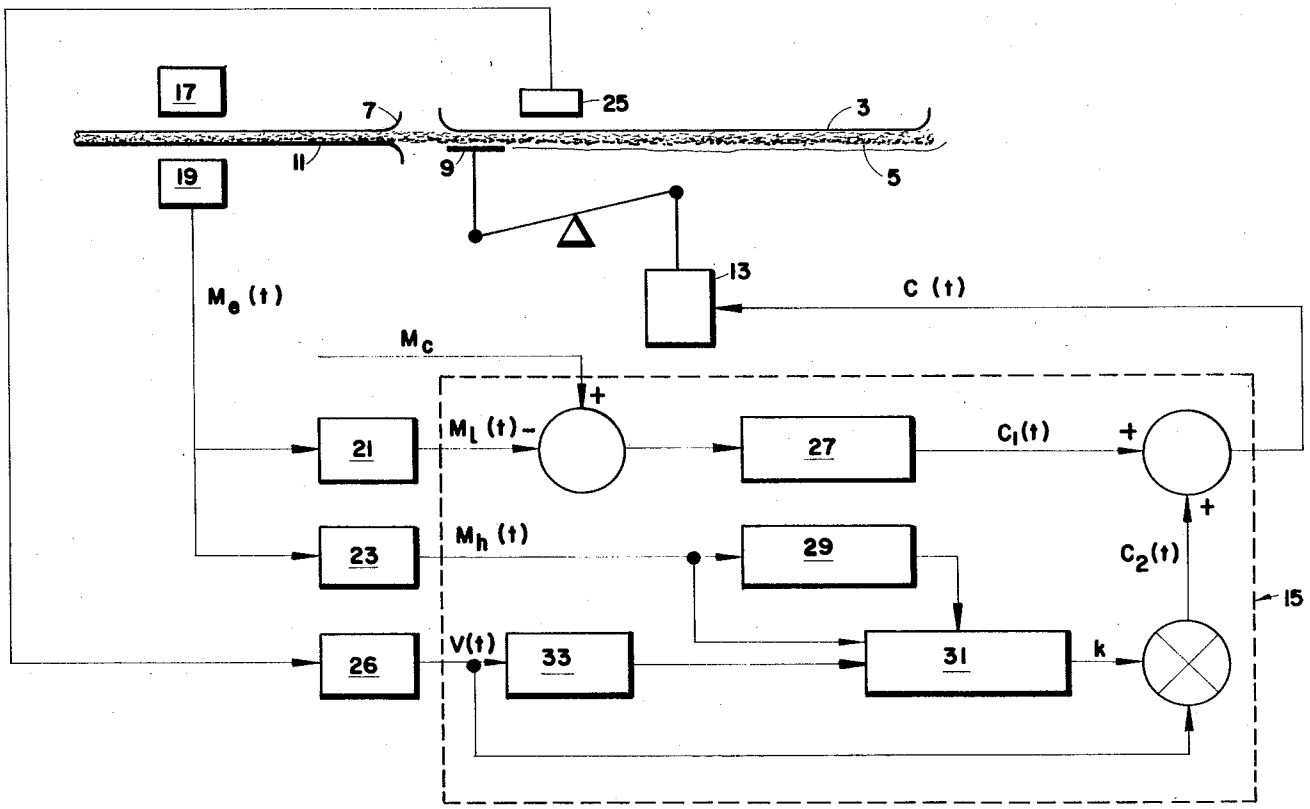
15
+
+
$C_2(t)$
k
$C_1(t)$
31
C (t)
27
29
3
5
13
25
+
33
$M_L(t)$ -
$M_h(t)$
V(t)
9
$M_c$
7
21
23
26
11
$M_e(t)$
17
19

ROD WEIGHT CONTROL FOR A CIGARETTE MAKING MACHINE

BACKGROUND OF THE INVENTION

In the manufacture of cigarettes on modern, high speed cigarette makers, extreme care is taken to assure that the cigarette rod is held to a specified firmness or density. If the cigarette rod is too dense, excessive tobacco will be used and the resulting cigarette may not have the desired smoking characteristics such as draft resistance, puff count, etc. If too little tobacco is used, the resulting cigarette will be undesirably soft, tobacco may fall out of the end of the rod, and as is the case with too dense a cigarette rod, the smoking characteristics will vary from the designed parameters.

Modern cigarette machines produce cigarettes at speeds approaching 8000 cigarettes per minute and an attempt is made to continuously monitor the density of the cigarette rod at that speed. Numerous pneumatic devices have been suggested such as those disclosed in U.S. Pat. Nos. 3,411,513; 3,595,067, and 3,850,029 and in British Pat. No. 1,372,056. These devices are (1) of the type employing floating nozzles issuing pressurized air onto the cigarette wrapper and either measure deformation of the wrapper or displacement of the nozzle based on the change in back pressure or (2) of a type providing a pressurized on-line chamber arrangement and observing pressure changes caused by variation of firmness or dimensions of cigarettes passing therethrough.

Alternate, non-pneumatic approaches to firmness measurement are set forth in U.S. Pat. No. 2,667,172 and South African Patent Application No. 73/9394. These devices suggest the use of tobacco rod forming elements of existing machinery for the additional function of providing output indication of rod firmness. In U.S. Pat. No. 2,667,172, an elongated short tongue is provided with a strain gauge positioned proximate its compression foot and a second gauge at the short tongue support clamp or beam. These gauges are in spaced longitudinal alignment whereby longitudinal pressures exerted by tobacco against the tongue may be sensed. This sensing apparatus is separate in function and operation from the tobacco rod firmness sensing apparatus of the South African Application. The latter apparatus comprises a single tongue support beam and foot adapted to provide output indication of vertical strain placed on the short tongue, i.e. movement of its foot transverse to the direction of movement of tobacco engaged thereby. The South African patent application relates also to specially constructed short tongues, disclosing a first embodiment wherein the compression foot of a short tongue is split into two successive longitudinal sections, each having a separate support flange with one support flange having a strain gauge thereon, and a further embodiment wherein the front compression foot section is further split into three circumferential segments, each having an independent support flange with a strain gauge thereon. Such support flanges are stems having one end terminating at the compression foot and an opposite end terminating at the tongue cantilever support beam.

A more recent advance to measure the firmness or density of the tobacco rod in a cigarette maker is to subject the formed tobacco rod to the radiation of beta or other suitable rays which are absorbed by the material in known proportion to its mass, and to determine the absorption by an ionization chamber. This system is disclosed in U.S. Pat. No. 2,704,079.

Once a signal is produced, either by a pneumatic sensor, a strain gauge type sensor or a beta ray type gauge, it can be suitably manipulated for feedback control of the amount of tobacco in the rod and therefore the cigarette rod density. This is normally accomplished by using the signal to control an ecreteur knife motor to adjust the position of the ecreteur knife relative to the tobacco supply vacuum belt. This belt is normally provided with excess tobacco and the ecreteur knife is utilized to slice off the excess tobacco to provide an accurate quantity of tobacco to the cigarette rod forming portion of the cigarette machine and produce rods of the desired density.

Besides sensing the firmness of the finished rod, a further refinement to more accurately control rod density employs a second, pneumatic sensor adjacent the tobacco vacuum feed belt to determine the density of the tobacco on the belt upstream from the ecreteur knife. The feed-forward signal form this second sensor is used in conjunction with the signal from the rod density control to control the position of the ecreteur knife.

A cigarette maker presently available which uses two input signals for weight control is offered by Molins Limited. The "Modic" controller on this machine uses the first signal in a threshold type feedback system such that when the signal from a $\beta$ gauge indicates a rod density error of more than $\frac{1}{2}\%$, the ecreteur knife motor is energized in the proper direction to bring the error to within $\pm\frac{1}{2}\%$ of the desired density. The ecreteur motor operates at a set speed and therefore responds at the same rate to correct minor or major error signals. The second signal (pneumatic sensor) drives a separate hydraulic positioner with a bellowscontrolled valve to provide more rapid, gross positioning of the ecreteur knife in a feed-forward arrangement.

A second feedback system, currently in use, is the "Accuray" Controller manufactured by Accuray Corporation. This system utilizes a digital computer to provide integral and proportional processing of the signals from a $\beta$ gauge to provide a loop control output signal for controlling the ecreteur motor and thereby provide a system with no net error. The "Accuray", like the Molins Modic, may also be employed in conjunction with a second, pneumatic, sensor.

However, these systems are not completely satisfactory in that the ecreteur knife positioning motor responds to the control signals at a fixed rate irrespective of the degree of error in rod density. Furthermore, there is no provision to automatically tune the feedforward systems to compensate for process changes. At the high output speeds of current cigarette machines, this can result in excessive production out of specifications before the error is corrected.

SUMMARY OF THE INVENTION

The subject invention relates to a cigarette maker rod density control wherein the quantity of tobacco in the rod and therefore the rod density is controlled by servo-controlling the ecreteur knife position in response to a signal produced by summing a proportional plus integral feedback signal from a $\beta$ rod density gauge and adding to this a feed-forward signal from a pneumatic tobacco bed density gauge to provide a high speed no-net error density control of a cigarette rod.

BRIEF DESCRIPTION OF THE DRAWING

The FIGURE illustrates a preferred schematic diagram for the rod density controller system of the present invention.

DESCRIPTION OF THE PREFERRED EMBODIMENT

Referring to the drawing, a portion of a cigarette making machine is illustrated including a vacuum tobacco feed belt 3 adapted to feed a bed of tobacco 5 to the rod forming area 7 of the cigarette making machine. A variable position ecreteur knife 9 is provided to remove or slice off excess tobacco from tobacco feed belt 3 such that the resulting cigarette rod 11 contains the amount of tobacco necessary to provide the desired rod density.

The ecreteur knife 9 is positioned by a servo 13 which is controlled by computer 15. For purposes of the present invention, a high speed servo solenoid positioner of the type manufactured by Ledex, Inc., model number 20, driven by a model 181695-001 controller, may be modified by installing lead-lag compensation and increasing the open-loop gain to extend the bandwidth and accuracy. This servo will respond to a continuously variable signal from the controlling computer rather than to threshold type signals.

The controlling computer 15 may be selected from any number of readily available general purpose data acquisition and control computers which would be suitable for this purpose, such as the MAC-SYM 350 computer manufactured by Analog Devices, Inc. The control computer provides an output control signal C(t) to the servo 13 in response to several inputs. A first "set-point" input $M_c$ provides a base line signal corresponding to the desired cigarette rod density or weight. A second input is provided by a $\beta$ mass density gauge comprising a $\beta$ ray source 17 and a $\beta$ ray detector 19. Alternatively, the $\beta$-ray detector, 19, may be arranged so that its output, $M_e(t)$, represents the difference between $M_c$ and the actual rod weight. In this case, $M_c$ would not appear as a separate input to control computer 15. The signal from detector 19 may be filtered through a low pass filter 21 such as a model 3750 adjustable filter manufactured by the Krohn-Hite Corporation set at a high pass frequency of 1 HZ to provide a low pass filtered signal $M_1(t)$ to the computer. The signal from detector 19 may also be filtered through a low-pass filter 23 such as the filter described above set at a high pass frequency of 25 HZ to provide a low-pass filtered signal $M_h(h)$ to the computer. A fourth signal is provided to the computer from a vacuum sensor transducer 25, for example, a Model DP-15 differential pressure transducer manufactured by the Validyne Engineering Corporation.

This transducer is utilized to provide an indication of the thickness or density of the tobacco bed on the vacuum belt 3 upstream of the ecreteur knife. The signal from the transducer 25 is filtered by a low-pass filter 26 of the type described above set in the low pass mode with a hi-pass frequency setting of 20 HZ to provide a signal V(t) as the fourth input to the computer.

With the aforementioned inputs to the computer, a dual mode control system is provided wherein one mode is based on long-term feedback of cigarette rod density and the second mode effects high-speed adaptive feed-forward control.

Operation of the control computer may be understood by reference to the drawing in which the dual mode control is apparent. The controller output, C(t) is formed by summing two components. Once of these $C_1(t)$, is simply the result of forming the difference between signal $M_c$ and the actual rod weight filtered signal $M_1(t)$ and then applying the differnece (or error) to a classical proportional-plus-integral controller 27 to provide the desired output signal. The signal $M_e(t)$ from the $\beta$ gauge detector is initially filtered to prevent system instabilities resulting from a transport lag of about $\frac{1}{4}$ second between the time tobacco passes the ecreteur knife and the time it is read by the $\beta$ gauge.

The second control signal $C_2(t)$, is derived by multiplying the vacuum signal, V(t), by a factor k. Since the vacuum signal is related to tobacco density measured just before the ecreteur knife, the $C_2(t)$ signal component is capable of responding very rapidly. However, since the trimming occurs after the measurement is made, there is no way to incorporate feedback in the $C_2$ computation. This component is thus determined in a feed-forward sense.

In principle, there is a value of k which would cause $C_2(t)$ to be the exact signal necessary to cause rapid rod density variations to be minimized for given machine and tobacco filler conditions. However, if those conditions change, a slightly different k is needed. Therefore, the value of k is continually adjusted in the disclosed control system to minimize the variance in the $M_h(t)$ signal. Whether to increase or decrease k is determined by digitally processing at block 31 the signal $M_h(t)$, the variance of $M_h(t)$ (from block 29), and a version of V(t) passed through a time delay block 33. The time delay is set equal to the transport lag encountered by the tobacco in moving from pneumatic sensor 25 to the $\beta$-gauge 19. The processing at 31 involves calculating the cross-correlation of $M_h(t)$ and V(t) at the transport lag and using the result along with the $M_h(t)$ variance to make update decisions on k. Because k is continually updated, this portion of the system can be considered an "adaptive feed-forward control".

With the system described, the control does not operate only when a threshold error level is exceeded but operates continuously to yield zero average weight error by driving a single high speed servo ecreteur positioner. Furthermore, by continually updating the feed-forward gain, k, short-term rod density variations are minimized.

While we have described the preferred embodiment of our invention it is to be understood that the invention is not limited thereto but may be otherwise embodied within the scope of the following claims.

We claim:

1. A rod weight control system for a cigarette making machine having a positionable ecreteur knife to adjust the quantity of tobacco fed to the rod forming section of the machine comprising:

a rod density gauge to provide a signal indicative of the density of the formed tobacco rod;

a tobacco bed density gauge to provide a signal indicative of the density of the tobacco on the vacuum tobacco supply belt upstream of the ecreteur knife;

control means adapted to provide a first, long term feedback control signal in response to the signal from said rod density gauge and a second, high speed feed-forward control signal in response to the signal from said tobacco bed density gauge;

summing means adapted to sum said first control signal and said second control signal to provide a continuous servocontrol signal; and high-speed servo means, aldapted for movement in response to said servo-control signal for positioning the ecreteur knife to maintain the cigarette rod density at the desired value.

2. A control system according to claim 1 wherein said rod density gauge is a $\beta$ gauge and said tobacco bed density gauge is a pneumatic gauge.

3. A control system according to claim 2 wherein said control means includes:

means for forming the difference between a set signal indicative of the desired rod weight and the signal from said $\beta$ gauge; and a proportional-plug-integral controller for processing said difference signal to produce said first, long term feedback control signal.

4. A control system according to claim 2 wherein said control system includes:

time delay means for processing the signal from said pneumatic gauge;

a variance computation means adapted to process the signal from said $\beta$ gauge.

computation means adapted to process the signal from said time delay means and said variance computation means to provide a feed forward gain k; and multiplier means adapted to multiply the signal from said pneumatic gauge by said gain k to produce said second, high speed feed-forward signal.

5. A control system according to claim 3 wherein said control system includes:

time delay means for processing the signal from said pneumatic gauge;

a variance computation means adapted to process the signal from said $\beta$ gauge;

computation means adapted to process the signal from said time delay means and said variance computation means to provide a feed forward gain k; and multiplier means adapted to multiply the signal from said pneumatic gauge by said gain k to produce said second, high speed feed-forward signal.

* * * * *